US008696080B2

(12) United States Patent
Cerro et al.

(10) Patent No.: US 8,696,080 B2
(45) Date of Patent: Apr. 15, 2014

(54) PRINTER INK DELIVERY WITH REFILL LINE PRESSURE SENSOR

(75) Inventors: Francesc Ros Cerro, Sant Vicent de Montait (ES); Richard Lewis, Santa Maria de Palautordera (ES); Marc Bautista Palacios, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 238 days.

(21) Appl. No.: 12/992,080

(22) PCT Filed: May 14, 2008

(86) PCT No.: PCT/US2008/063584

§ 371 (c)(1), (2), (4) Date: Nov. 10, 2010

(87) PCT Pub. No.: WO2009/139772

PCT Pub. Date: Nov. 19, 2009

(65) Prior Publication Data

US 2011/0063345 A1 Mar. 17, 2011

(51) Int. Cl.
*B41J 2/195* (2006.01)

(52) U.S. Cl.
USPC ..... 347/7; 347/89

(58) Field of Classification Search
USPC ..... 347/5–7, 14, 17, 19, 84–87; 222/92, 95, 222/97, 207, 209, 212, 214
See application file for complete search history.

(56) References Cited

U.S. PATENT DOCUMENTS

| | | | | |
|---|---|---|---|---|
| 6,935,729 | B2 * | 8/2005 | De Marco et al. | 347/73 |
| 2002/0196316 | A1 | 12/2002 | Nakamura | |
| 2003/0007040 | A1 | 1/2003 | Love et al. | |
| 2003/0007049 | A1 | 1/2003 | Hino | |
| 2003/0011668 | A1 | 1/2003 | Yoshida | |

FOREIGN PATENT DOCUMENTS

| | | | |
|---|---|---|---|
| EP | 1577096 | A1 | 9/2005 |
| EP | 1806-615 | A1 | 7/2007 |
| EP | 1876024 | A1 | 1/2008 |
| JP | 2003-136742 | A | 5/2003 |
| JP | 2004-188857 | A | 7/2004 |
| JP | 2008-12910 | A | 1/2008 |
| WO | WO-0023280 | A1 | 4/2000 |

* cited by examiner

*Primary Examiner* — Juanita D Jackson

(57) ABSTRACT

An ink delivery system for a printer. In one embodiment, the system includes an ink supply that contains ink to be delivered to a printhead of the printer and an ink buffer positioned physically below the ink supply such that ink can flow to the ink buffer under gravity alone, the ink buffer being configured to be repeatedly filled with ink from the ink supply and to deliver that ink to the printhead.

8 Claims, 6 Drawing Sheets

PRINTER INK DELIVERY WITH REFILL LINE PRESSURE SENSOR

BACKGROUND

Large format printers consume large amounts of ink during operation. Currently under development are high volume ink supplies suitable for use in such printers. In some embodiments, the ink supplies hold as much as five liters of ink.

Despite the high capacity of the above-described high volume ink supplies, it is still possible for the ink to run out in the middle of a print and, when the printer is configured as a plotter-type printer, during the middle of a printing pass, which can adversely affect print quality and may even require reprinting from the start of the plot.

BRIEF DESCRIPTION OF THE DRAWINGS

The disclosed ink delivery systems can be better understood with reference to the following drawings. The components in the drawings are not necessarily to scale.

DETAILED DESCRIPTION

Disclosed herein are ink delivery systems for printers, such as large format printers. As described in the following, the ink delivery systems are configured to deliver ink to a printhead of a printer from a relatively small ink buffer that is filled by a high volume ink supply. In some embodiments, the ink buffer comprises two intermediate ink tanks. In such cases, one of the intermediate ink tanks is used to feed the printhead while the other intermediate ink tank is refilled by the high volume ink supply, thereby enabling continuous printing. In some embodiments, refilling of the intermediate ink tanks is controlled relative to the pressure within a refill line that extends from the high volume ink supply to the intermediate ink tanks.

Figure 1:
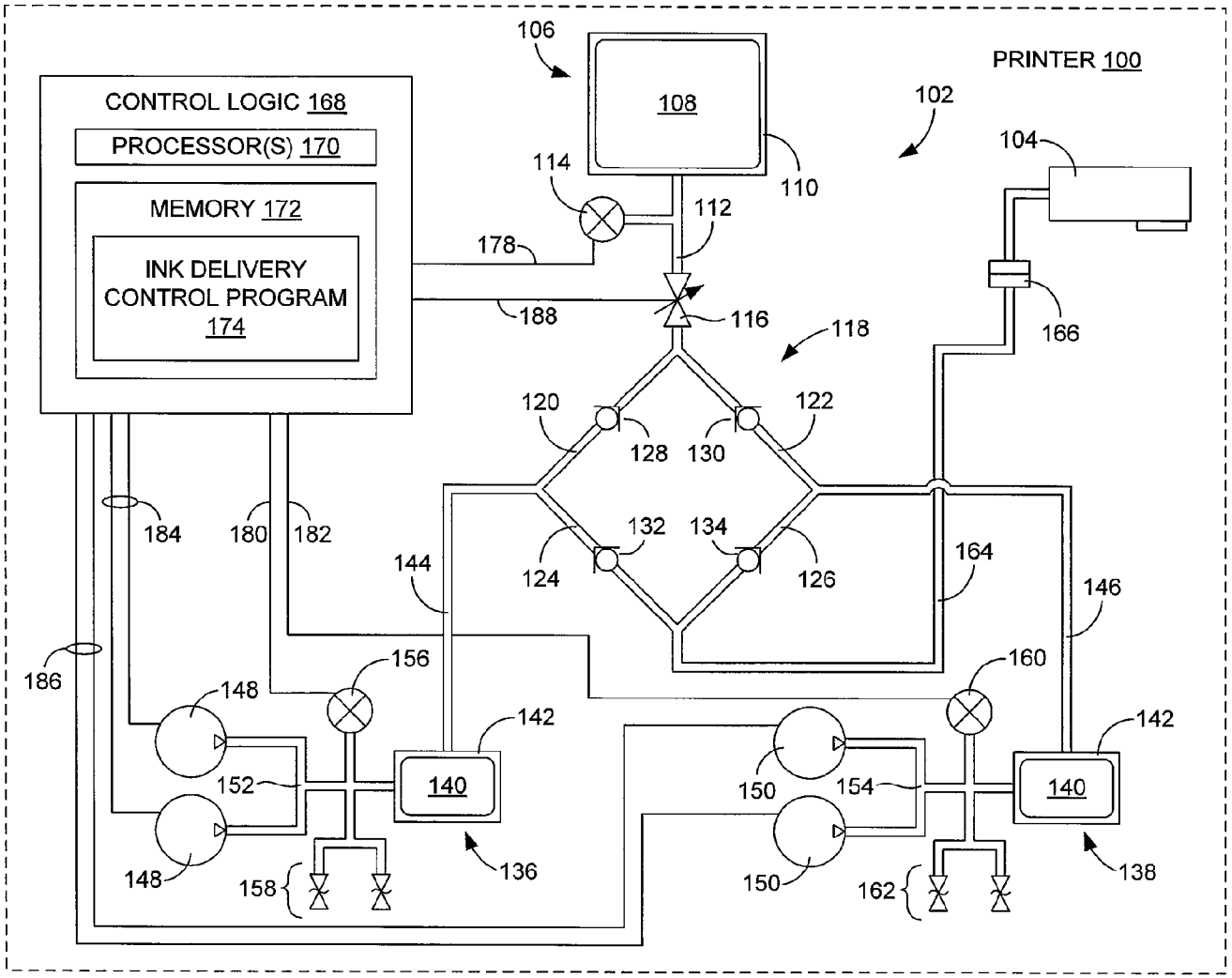
FIG. 1 is schematic view of a first embodiment of a printer and its ink delivery system.

Referring now in more detail to the drawings, in which like numerals indicate corresponding parts throughout the views, FIG. 1 illustrates various components of a first embodiment of a printer 100. By way of example, the printer 100 comprises a large format, plotter-type printer. Irrespective of its configuration, the printer 100 comprises an ink delivery system 102 that is used to deliver ink to a printhead 104 of the printer.

The ink delivery system 102 includes a high volume ink supply 106, which serves as the main ink supply for a single color of ink used by the printer 100. In embodiments in which the print is a color printer, one such ink supply is provided for each color. Those additional ink supplies are not shown in FIG. 1 for purposes of clarity. By way of example, the ink supply 106 is configured as a bag-in-box container that includes a pliable fluid containment bag 108 that is contained within an outer carton or box 110. In some embodiments, the fluid containment bag is composed of plastic and has a maximum capacity of several liters, such as approximately 3 to 5 liters (l).

Connected to the high volume ink supply 106 is a refill line 112 that extends from the ink containment bag of the ink supply toward an ink buffer described below. Positioned along the refill line 112 is an ink pressure sensor 114 configured to measure the pressure within the refill line. As described below, the pressure within the refill line 112 is indicative of various states of the ink supply system 102 and, more particularly, system operation during refilling of the ink buffer. Also provided along the refill line 112 is a refill control valve 116 that can be selectively actuated to enable or disable the flow of ink from the ink supply 106 and through the refill line. By way of example, the refill control valve 116 comprises an electrically-actuated valve that can be controlled with electrical control signals issued by the printer 100.

With further reference to FIG. 1, the ink delivery system 102 also includes a flow director 118 that automatically controls the direction in which ink flows relative to the system's current state of operation. The flow director 118 includes various lines or legs through which ink can flow, including a first leg 120, a second leg 122, a third leg 124, and a fourth leg 126. Provided along each of the legs 120-126 is a check valve, namely check valves 128, 130, 132, and 134, respectively. By way of example, each check valve 128-134 comprises a ball check valve that, at least ideally, limits flow through the valve to a single direction. Therefore, the check valves 128 and 130 enable flow away from the high volume ink supply 106 and, as discussed below, the check valves 132 and 134 enable flow toward the printhead 104. In other embodiments, the check valves 128-134 can be replaced with electronically controlled solenoid valves or piloted valves. Such valves may be more robust than check valves and, therefore, may better prevent leakage of ink through the lines in which they are used.

As mentioned above, the ink delivery system 102 further includes an ink buffer that lies between the high volume ink supply 106 and the printhead 104. In particular, the ink buffer is positioned between the high volume ink supply 106 and the printhead 104 in a position in which the ink buffer is physically lower than the ink supply so that ink can flow to the ink buffer under the force of gravity alone. In the embodiment of FIG. 1, the ink buffer comprises first and second intermediate ink tanks 136 and 138. By way of example, each intermediate ink tank 136, 138 comprises a pliable fluid containment bag 140 similar to the bag of the ink supply 106 that is provided within a rigid or semi-rigid outer container 142, such as a plastic bottle. In some embodiments, the fluid containment bags 140 each can hold approximately 800 cubic centimeters (cc) of liquid ink. Regardless, each outer container 142 is sealed around its fluid containment bag 140 such that the container can be pressurized to squeeze the bag and cause ink to flow out from the bag under pressure.

In fluid communication with the first and third legs 120, 124 of the flow director 118 is a first intermediate ink tank line 144 that is in fluid communication with the fluid containment bag 140 of the first intermediate ink tank 136. In similar manner, in fluid communication with the second and fourth legs 122, 126 of the flow director 118 is a second intermediate ink tank line 146 that is in fluid communication with the fluid containment bag 140 of the second intermediate ink tank 138. As described below, ink can flow through the lines 144, 146 either toward or away from its associated intermediate ink tank 136, 138 depending upon the current state of the ink delivery system 102.

With continued reference to FIG. 1, the ink delivery system 102 further comprises a pressurization system that is used to selectively pressurize the fluid containment bags 140 of the intermediate ink tanks 136, 138. In the illustrated embodiment, the pressurization system is an air pressurization system that includes a first pair of air pumps 148 and a second pair of air pumps 150. One or both of the air pumps 148 are used to deliver pressurized air to the first intermediate ink tank 136 and, more particularly its outer container 142, along a first air supply line 152. In similar manner, one or both of the air pumps 150 are used to deliver pressurized air to the second intermediate ink tank 138 and, more particularly its outer container 142, along a second air supply line 154. Notably, in embodiments in which the printer 100 is a color printer that uses more than one color of ink, the air pumps 148, 150 may also be used to simultaneously supply pressurized air to the intermediate ink tanks used to deliver the other colors of ink (not shown). Provided along the first air supply line 152 is a first air pressure sensor 156 and a pair of pressure relief valves 158. Provided along the second air supply line 154 is a second air pressure sensor 160 and a pair of pressure relief valves 162.

In fluid communication with the third and fourth legs 124, 126 of the flow director 118 is a printhead supply line 164 that leads toward the printhead 104. As indicated in FIG. 1, a coupler 166 can be provided on the printhead supply line 164 that enables coupling and decoupling of the printhead 104 from the ink delivery system 102.

Operation of the ink delivery system 102 is, at least in part, automatically controlled by the printer 100. In the embodiment of FIG. 1, the ink delivery system 102 is controlled by control logic 168 of the printer 100 that comprises one or more processors 170 and memory 172. As indicated in FIG. 1, stored in memory 172 is an ink delivery control program 174 that comprises the instructions that are executed by the processor(s) 170 to control operation of the ink delivery system 102. Although the control logic 168 is functionally depicted in FIG. 1 as a single control point, it is noted that the control logic can comprise multiple components that are used in conjunction to control the ink delivery system 102. Furthermore, although the memory 172 is identified separately from the processor(s) 170, it is noted that all or a portion of the memory may be comprised by the processor(s). Moreover, it is noted that the control logic 168 may comprise various components that are not explicitly identified in FIG. 1, such as one or more application-specific integrated circuits (ASICs), circuit boards, and the like.

Various communication lines (e.g., wires) extend between the control logic 168 and particular components of the fluid delivery system 102. Such lines include communication lines 178, 180, and 182 over which pressure signals from the pressure sensors 114, 156, and 160, respectively, are provided to the control logic 168. In addition, the lines include communication lines 184 and 186 used to send control signals from the control logic 168 to the air pumps 148 and 150, respectively. Furthermore, the lines include communication line 188 used to send control signals from the control logic 168 to the refill control valve 116. Notably, the system can comprise further communication lines, such as communication lines (not shown) that extend to the pressure relief valves 158, 162.

The ink delivery system 102 having been described above, a method for controlling the delivery of ink with the system will now be described with reference to the flow diagram of FIGS. 2A and 2B. By way of example, that method is performed by the printer 100 and, more particularity, its ink delivery control program 174 identified in FIG. 1. In the following discussion, it is assumed that the ink delivery system 102 is in a state in which the high volume ink supply 106 contains an ample supply of ink, the first intermediate ink tank 136 is currently being used to deliver ink to the printhead 104 and is therefore pressurized, and the second intermediate ink tank 138 is filled and is on standby. Furthermore, it is assumed that each ink line of the system 102 is already filled with ink.

Figure 3A:
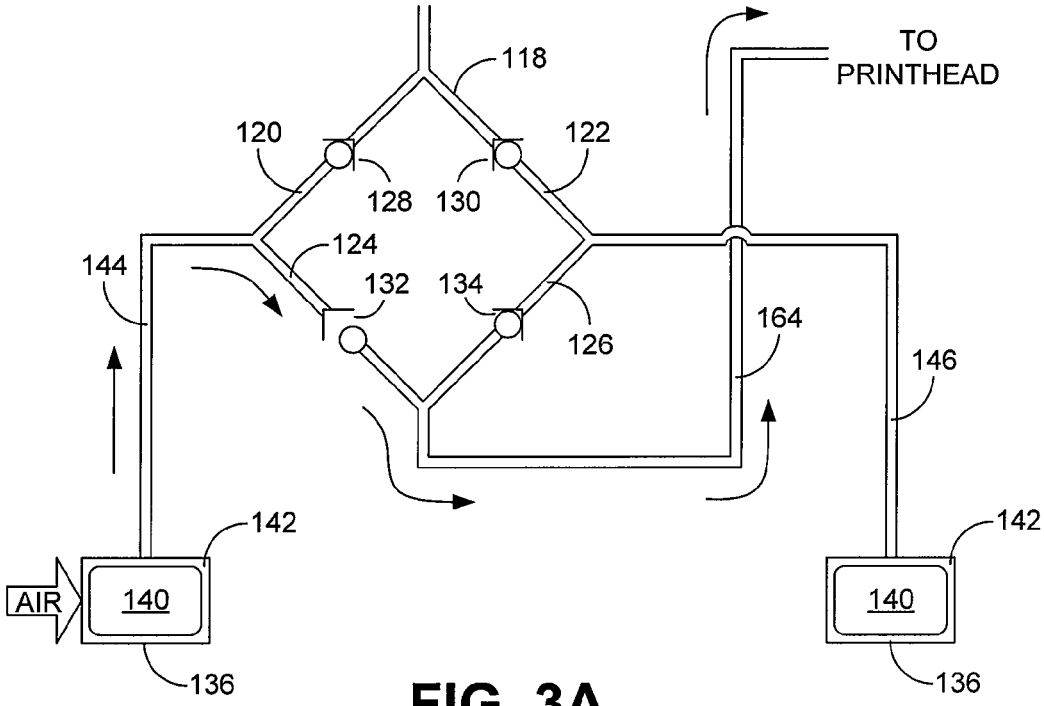
FIG. 3A is a schematic diagram illustrating a portion of the system of FIG. 1 and depicting the flow of ink during a first stage of the method of FIG. 2.

It is noted that, because the first intermediate ink tank 136 is pressurized, pressure is exerted upon its fluid containment bag 140 so that ink will flow out from the bag and into the first intermediate ink tank line 144 when ink is drawn by the printhead 104. That flow causes the ink already contained within the first intermediate ink tank line 144 to flow into the flow director 118. Because of the orientation of the first check valve 128, that ink cannot flow back through the first leg 120 of the flow director 118 and into the refill line 112. However, because of the orientation of the third check valve 132, ink flow through the third leg 124 of the flow director 118 is enabled such that ink can be delivered to the printhead supply line 164. Such flow is depicted in FIG. 3A with solid arrows. Notably, due to the orientation of the fourth check valve 134, the ink that flows through the third leg 123 cannot flow through the fourth leg 126 and to the other intermediate ink tank 138.

Figure 2A:
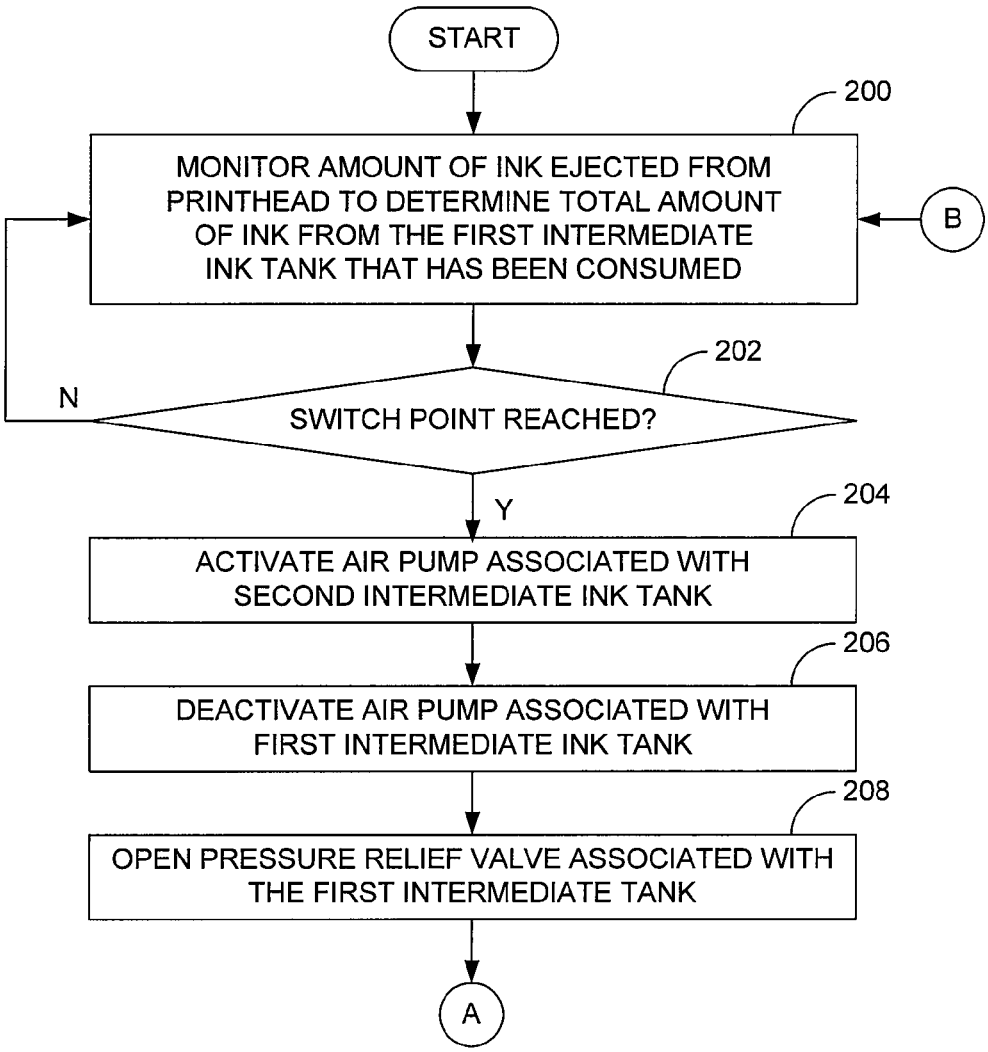
FIG. 2 is a flow diagram of an embodiment of a method for controlling the delivery of ink using the ink delivery system shown in FIG. 1.
Figure 2B:
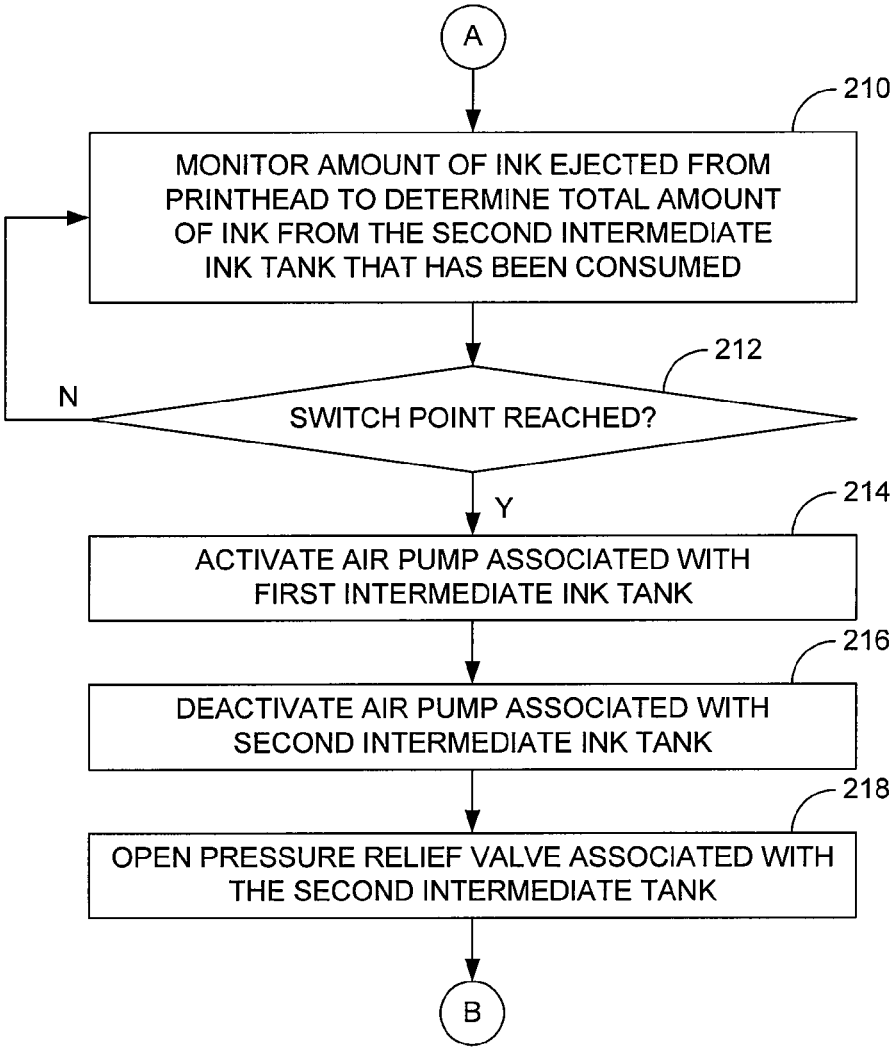

Turning now to block 200 of FIG. 2A, the amount of ink ejected from the printhead 104 is monitored to determine the total amount of ink from the first intermediate ink tank 136 that has been consumed. By way of example, monitoring comprises counting the number of droplets of ink that are ejected once the first intermediate ink tank had begun to deliver ink, and the total consumption is calculated using the known volume of each droplet. With that consumption information, the printer 100 can estimate the volume of ink that has been delivered by the first intermediate ink tank 136 and, therefore, the amount of ink that remains in the ink tank.

By tracking the amount of ink left in the first intermediate ink tank 136, the printer 100 can then determine whether a switch point has been reached, as indicated in decision block 202. That is, the printer 100 can determine whether the volume of ink contained in the first intermediate ink tank 136 has decreased to a point at which delivery of ink to the printhead 104 should switch from the first intermediate ink tank to the second intermediate ink tank 138. By way of example, the switch point can be the point at which the first intermediate ink tank 136 is approximately half empty.

If the switch point has not yet been reached, the monitoring of block 200 continues. If, however, the switch point is reached, the process continues down to block 204 at which an air pump 150 associated with the second intermediate ink tank 138 is activated. Such activation then pressurizes the outer container 142 of the second intermediate ink tank 138. Once the second intermediate ink tank 138 has been pressurized to within a working range, the air pump 148 associated with the first intermediate ink tank is deactivated, as indicated in block 206. Once the air pump 148 is deactivated, a pressure relief valve 158 associated with the first intermediate ink tank 136 can be opened, as indicated in block 208, to depressurize the outer container 142 and decrease the pressure exerted upon the fluid containment bag 140 of the first intermediate ink tank.

Figure 3B:
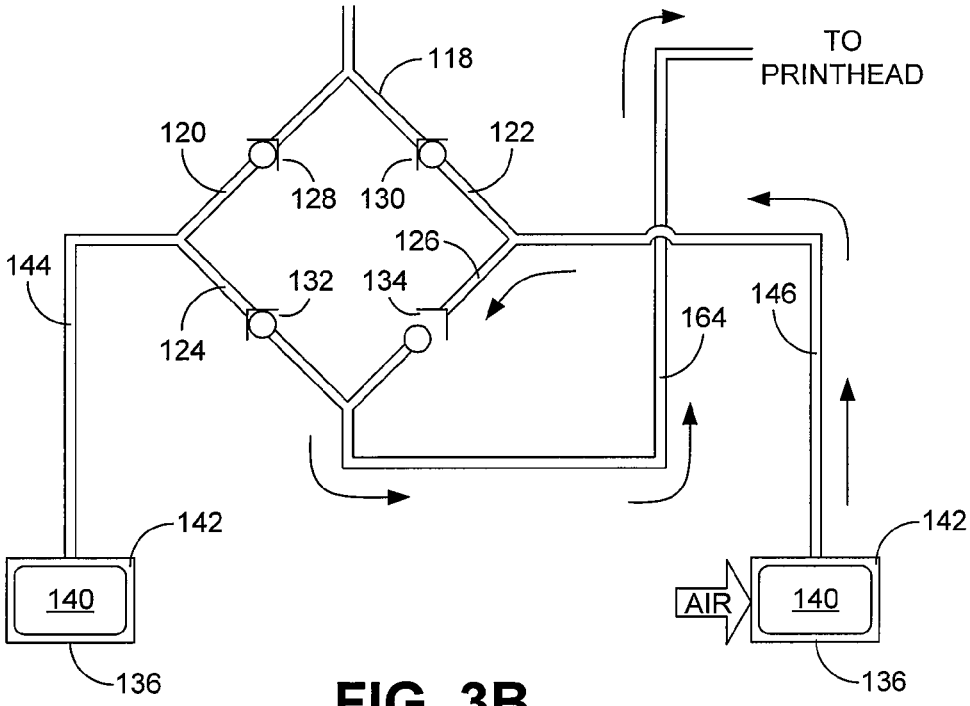
FIG. 3B is a schematic diagram illustrating a portion of the system of FIG. 1 and depicting the flow of ink during a second stage of the method of FIG. 2.

At this point, operation of the ink delivery system 102 shifts from delivery of ink from the first intermediate ink tank 136 to delivery of ink from the second intermediate ink tank 138. In particular, when the air pump 150 associated with the second intermediate ink tank 1380 is activated, it pressurizes the outer container 142 of the second intermediate ink tank to thereby squeeze the fluid containment bag 140 within the container. Because of the increased pressure of the ink contained in the fluid containment bag 140, ink flows out from the bag and into the second intermediate ink tank line 146. That flow forces the ink already contained within the second intermediate ink tank line 146 to flow into the flow director 118. Because of the orientation of the second check valve 130, that ink cannot flow back through the second leg 120 of the flow director 118 and into the refill line 112. However, because of the orientation of the fourth check valve 134, ink flow through the fourth leg 126 of the flow director 118 is enabled such that ink can be delivered to the printhead supply line 164. Such flow is depicted in FIG. 3B with solid arrows.

Referring next to block 210 of FIG. 2B, the printer 100 again monitors the amount of ink that is ejected and this time determines the total amount of ink that has been consumed from the second intermediate ink tank 138 so, as before, the printer can determine whether a further switch point has been reached (decision block 212). If the switch point has not yet been reached, the monitoring of block 210 continues. If, on the other hand, the switch point is reached, the air pump 148 associated with the first intermediate ink tank 136 is activated (block 214), the air pump 150 associated with the second intermediate ink tank 138 is deactivated (block 216), and the pressure relief valve 162 associated with the second intermediate ink tank are opened (block 218)

At that point, the process returns to block 200 of FIG. 2A and is repeated in the same manner described above. Therefore, the duty of delivering ink alternates between the first intermediate ink tank 136 and the second intermediate ink tank 138. Notably, the intermediate ink tank that is not currently in use delivering ink can be refilled while the other intermediate ink tank provides ink to the printhead 104. An embodiment of a method for controlling such refilling is described below in relation to FIG. 4. Assuming that the intermediate ink tanks 136, 138 are refilled when not in use delivering ink, the ink delivery system 102 can be continuously operated to deliver ink to the printhead 104. Therefore, one of the intermediate ink tanks will be available at any given time to deliver the ink needed for printing. This is true even when the high volume ink supply 106 runs out of ink, in which case the printer operator can be notified and will have ample time to replace that supply prior to the intermediate ink tanks 136, 138 being exhausted. Significantly, such continuous printing is made possible without requiring the customer to purchase multiple high volume ink supplies 106 for each color of ink used by the printer 100.

It is further noted that, when the ink delivery system 102 comprises multiple colors of ink, and therefore multiple high volume ink supplies 106 and associated intermediate ink tanks 136, 138, the switching from a given intermediate ink tank to the other intermediate ink tank is performed simultaneously for each color of ink. For example, if the first intermediate ink tank 136 for the color black reaches its switch point as determined by ink usages, change over to delivery of ink from the second intermediate ink tank 138 for each color of the printer, including black, is simultaneously performed. Therefore, the switching process is synchronized for every color of ink used by the printer.

The ink delivery system 102 comprises other inherent advantages. For example, because air pumps are used to pressurize a bag that contains the ink to be delivered, the system 102 does not need invasive liquid pressurization systems, which have design constraints and both reliability and longevity issues. In addition, ink can be delivered from the high volume ink supply 102 using gravity alone, therefore obviating the need for a large and costly pressurization system that forces ink from the ink supply to the intermediate ink tanks. Furthermore, the ink delivery system 102 is very simple in both design and construction, and therefore can be manufactured and sold at relatively low cost.

Figure 4:
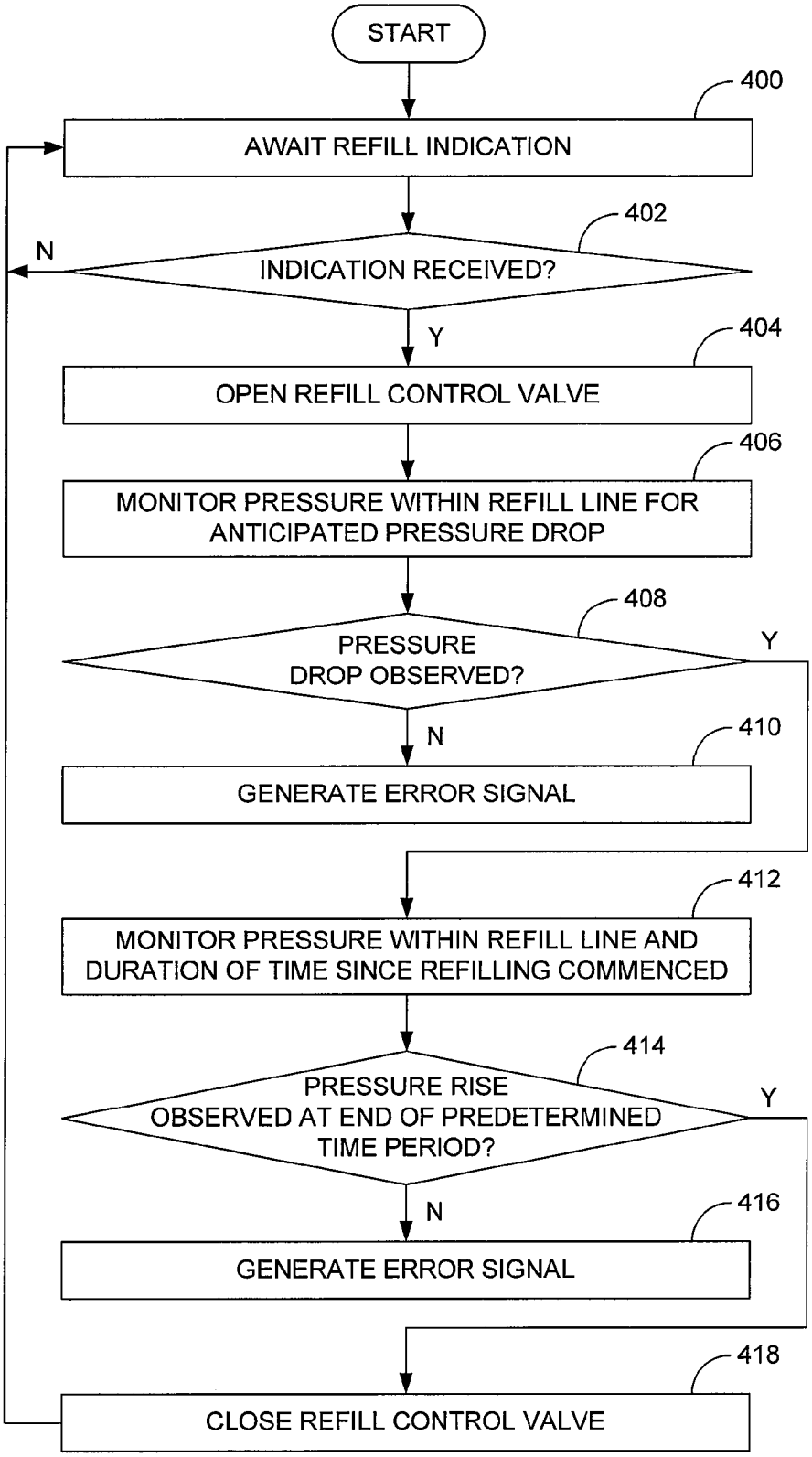
FIG. 4 is a flow diagram of an embodiment of a method for controlling the refilling of intermediate ink tanks used in the printer of FIG. 1.

As described above, the intermediate ink tanks 136, 138 can be refilled when they are not being used to deliver ink to the printhead 104. FIG. 4 describes an example method for controlling such refilling. In FIG. 4, it is assumed that the ink delivery system 102 has just switched from delivery of ink from the first intermediate ink tank 136 to delivery of ink from the second intermediate ink tank 138. Therefore, the process described in FIG. 4 can begin after block 208 of FIG. 2, at which the air pump 148 associated with the first intermediate ink supply 136 was deactivated.

Beginning with block 400 of FIG. 4, the printer 100 and, more particularly, the ink delivery control program 174, awaits a refill indication. In some embodiments, the indication comprises an indication that the delivery of ink has been successfully switched from one intermediate ink tank to the other. With reference to decision block 402, if the refill indication is not received, the process continues at block 400 at which the indication is awaited. If, however, the refill indication is received, the process continues down to block 404 at which the refill control valve 116 is opened. As mentioned above, the high volume ink supply 106 is positioned physically higher than the intermediate ink tanks 136, 138. The ink supply 106 is further positioned physically higher than the flow director 118, which enables ink to flow out from the ink supply and into the refill line 112 under the force of gravity alone. Notably, the ink supply 106 is positioned a large enough distance above the intermediate ink tanks 136, 138 to ensure that the ink tanks can be refilled at least as quickly as they can be depleted during printing. By way of example, the ink supply 106 is positioned approximately 1.5 meters higher than the intermediate ink tanks 136, 138, which results in a static head pressure (i.e., when there is no flow) within the refill line 112 of approximately 2 pounds per square inch (psi). That height also ensures that there is sufficient suction applied to the fluid containment bag of the ink supply 106 as the bag nears its empty condition to reduce the amount of ink that is left in the bag and is therefore not used.

Figure 5A:
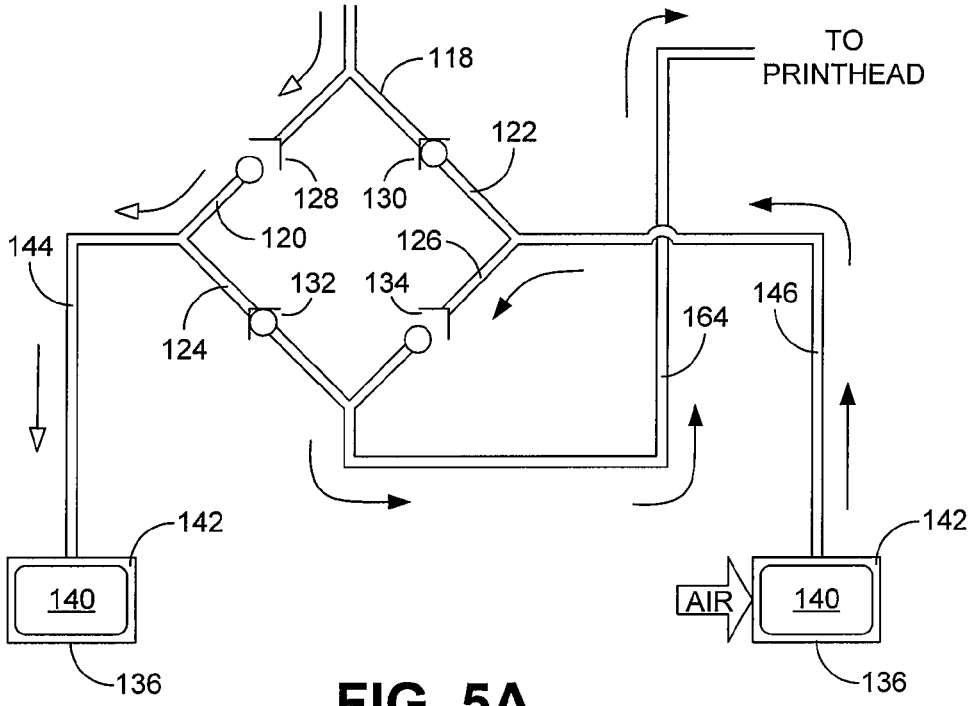
FIG. 5A is a schematic diagram illustrating a portion of the system of FIG. 1 and depicting the flow of ink during a first stage of the method of FIG. 4.

Because of the orientations of the first and second check valves 128, 130, the ink within the refill line 112 potentially can flow through either of the first and second legs 120, 122 of the flow director 118. However, assuming that the second intermediate ink tank 138 is being used to deliver ink to the printhead 104 and is therefore pressurized, the ink from the refill line 112 is limited to flowing through the first leg 120 of the flow director 118. That ink can therefore flow through the first leg 120, through the first intermediate ink tank line 144, and into the fluid containment bag 140 of the first intermediate ink tank 136 to refill the ink tank. Such refilling is depicted by the outline arrows (i.e., non-solid arrows) of FIG. 5A.

The ink pressure sensor 114 provided along the refill line 112 can be used to acquire various information about the ink delivery system 102 and the refill process in particular. As mentioned above, the head pressure within the refill line 112 is approximately 2 psi when there is no flow through the line. When ink flows during refilling, however, that pressure drops to a lower level due to dynamic losses. By way of example, the pressure within the refill line 112 drops to approximately 1.4 psi. Since the ink pressure sensor 114 can detect that pressure drop (as well as pressure increases), measurements from the sensor can be used as feedback as to the operation of the ink delivery system 102 and the refill process.

With reference again to FIG. 4, pressure within the refill line 112 can be monitored for an anticipated pressure drop, as indicated in block 406. Such a pressure drop (e.g., 0.6 psi) signals to the printer 100 that ink is now flowing through the refill line 112 as a result of the opening of the refill control valve 116. If the anticipated pressure drop occurs, the process may continue down to block 412 described below. However, if the anticipated pressure drop does not occur within a predetermined period of time (e.g., 3 seconds), there may be an issue with the ink delivery system 102 that is preventing the flow of ink to the first intermediate ink tank 136. By way of example, there may be a blockage along the path from the high volume ink supply 106 to the first intermediate ink tank 136 or the check valve 128 may be stuck in the closed position. Regardless, refilling is not occurring and normal operation of the printer is not possible. Therefore, a fault is presumed and, as indicated in block 410, an error signal is generated for the printer operator to alert him or her to the situation. At that point, operation of the printer is halted and, therefore, the refill process is at least temporarily interrupted.

Assuming that there is the anticipated pressure drop within the refill line 112, ink will flow under the force of gravity into the fluid containment bag 140 of the first intermediate ink tank 136. As the fluid containment bag 140 nears its maximum capacity, the pressure within the bag rises, which causes the pressure within the first intermediate ink tank line 144, the first leg 120 of the flow director 118, and the refill line 112 to increase. Such a pressure increase can therefore signal that the first intermediate ink tank 136 is nearly full and that the refilling process is nearly completed. It may be desirable to halt refilling at a point before the fluid containment bag 140 is completely filled to avoid overpressurizing the bag. Therefore, refilling can be halted at a point at which the pressure within the refill line 112 correlates with the desired fill level of the fluid containment bag 140. By way of example, that pressure is approximately 1.6 psi. To that end, the process continues to block 412 at which the pressure within the refill line 112 and the duration of time since refilling commenced is monitored.

The time duration since refilling commenced is monitored to provide feedback that can warn the printer 100 of a potential leak in the ink delivery system 102. Specifically, if the pressure within the refill line 112 does not rise to the predetermined pressure at which refilling would be halted after a predetermined period of time (e.g., 8 minutes), the ink may be flowing out from the ink delivery system 102. Therefore, as indicated in decision block 414, it can be determined whether the pressure rise is observed at the end of the predetermined time period. If not, a fault is presumed and, as indicated in block 416, an error signal is generated for the printer operator. At that point, operation of the printer is halted and, therefore, the refill process is at least temporarily interrupted.

Figure 5B:
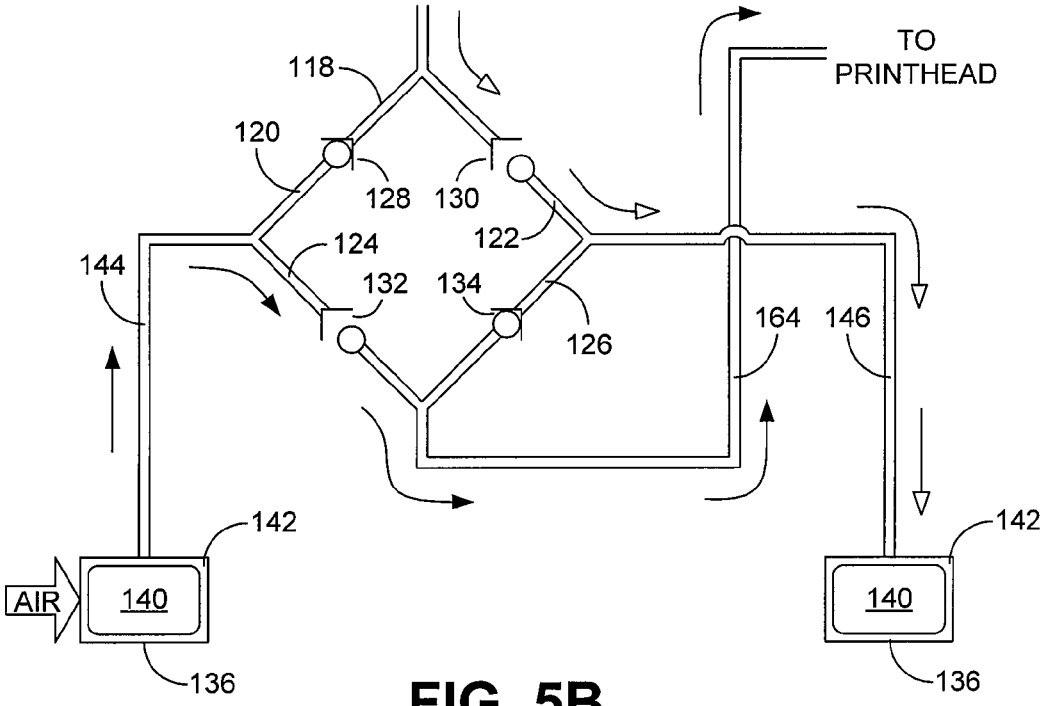
FIG. 5B is a schematic diagram illustrating a portion of the system of FIG. 1 and depicting the flow of ink during a second stage of the method of FIG. 4.

Assuming on the other hand that the anticipated pressure rise occurs, indicating that the fluid containment bag 140 of the first intermediate ink tank 136 has been filled to the desired level, the process continues to block 418 at which the refill control valve 116 is closed. The process can then return to block 400 at which the printer 100 awaits a further refill indication, this time indicating that the second intermediate ink tank 138 is to be refilled. The direction of flow during such refilling is depicted in FIG. 5B with outline arrows.

As can be appreciated from the above, the intermediate ink tanks 136, 138 can be are alternately filled as delivery of ink is switched from one intermediate ink tank to the other. Notably, refilling of each intermediate ink tank 136, 138 occurs faster than the ink contained within the other intermediate ink tank can be depleted. Therefore, refilling is followed by a standby period during which the printer 100 waits for a switch point to be reached (see FIG. 2).

As can also be appreciated from the above, feedback from the ink pressure sensor 114 can be used to determine when to cease the refilling process as well as to diagnose the health of the ink delivery system 102 and the refilling process. It is further noted that the ink pressure sensor 114 can be used to determine when the high volume ink supply 106 is running low on ink. Specifically, if the pressure within the refill line 112 falls significantly below the pressure normally observed during refilling (e.g., 1.4 psi), the ink supply 106 may be nearly out of ink. By way of example, an out-of-ink condition can be presumed when the pressure falls to approximately 0.6 psi.

Programs comprising logic have been described herein. Those programs can be stored on any computer-readable medium for use by or in connection with a computer-related system or method. In the context of this document, a computer-readable medium is an electronic, magnetic, optical, or other physical device or means that contains or stores instructions for use by or in connection with a computer-related system or method.

Claimed are:

1. An ink delivery system for a printer, the system comprising:

an ink supply that contains ink to be delivered to a printhead of the printer;

an ink buffer in fluid communication with the ink supply and the printhead, the ink buffer being positioned physically below the ink supply such that ink can flow to the ink buffer under gravity alone, the ink buffer being to be repeatedly filled with ink from the ink supply and to deliver that ink to the printhead;

a refill line that extends down from the ink supply through which ink can flow to the ink buffer;

a refill control valve provided along the refill line, wherein the refill control valve can be selectively actuated to control the flow of ink through the refill line; and an ink pressure sensor provided along the refill line to measure the pressure of ink within the refill line between the ink supply and the ink buffer.

2. The system of claim 1, further comprising control logic that actuates the refill control valve, the control logic being to open the refill control valve to refill the ink buffer and to close the refill control valve after refilling is completed based at least in part on the pressure of ink within the refill line.

3. The system of claim 1, wherein the control logic is to generate an error signal if a pressure drop does not occur within the refill line after the refill control valve is opened.

4. The system of claim 1, wherein the ink delivery control program is further to signal a printer operator that the ink supply is nearly empty if the pressure within the refill line drops to a predetermined low pressure during refilling.

5. A printer comprising:

a printhead;

a processor;

memory that stores an ink delivery control program;

an ink delivery system that is controlled by the ink delivery control program, the system including:

an ink supply that contains ink to be delivered to the printhead;

an ink buffer in fluid communication with the ink supply and the printhead, the ink buffer being positioned physically below the ink supply such that ink can flow to the ink buffer under gravity alone, the ink buffer being to be repeatedly filled with ink from the ink supply and to deliver that ink to the printhead, a refill line that extends down from the ink supply through which ink can flow to the ink buffer, and a refill control valve provided along the refill line, wherein the refill control valve can be selectively actuated to control the flow of ink through the refill line, an ink pressure sensor provided along the refill line to measure the pressure of ink within the refill line between the ink supply and the ink buffer; and wherein the ink delivery control program actuates the refill control valve based on the pressure within the refill line and is the control logic to monitor the pressure within the refill line during refilling.

6. The printer of claim 5, wherein the ink delivery control program is further to generate an error signal if a pressure drop does not occur within the refill line after the refill control valve is opened.

7. The printer of claim 5, wherein the ink delivery control program is further to generate an error signal if a pressure rise does not occur within the refill line after a predetermined period of time after refilling has commenced.

8. The printer of claim 5, wherein the ink delivery control program is further to signal a printer operator that the ink supply is nearly empty if the pressure within the refill line drops to a predetermined low pressure during refilling.

* * * * *